US005375105A

United States Patent [19]

Borowski

[11] Patent Number: 5,375,105

[45] Date of Patent: Dec. 20, 1994

[54] TIMEKEEPING RATE REGULATOR FOR CRYSTAL CONTROLLED WATCHES AND CLOCKS

[76] Inventor: Raymond J. Borowski, 5 Sandalwood Dr., Apt. 15A, Ft. Walton Beach, Fla. 32548

[21] Appl. No.: 95,145

[22] Filed: Jul. 20, 1993

[51] Int. Cl.[5] ..... G04B 17/12

[52] U.S. Cl. ..... 368/202; 368/200; 368/201

[58] Field of Search ..... 368/200–202

[56] References Cited

U.S. PATENT DOCUMENTS

| | | | |
|---|---|---|---|
| 968,235 | 8/1910 | Bonnet | 368/201 |
| 1,584,528 | 5/1926 | Grainger | 368/201 |
| 3,540,207 | 11/1970 | Keeler | 368/201 |
| 4,101,838 | 7/1978 | Aihara et al. | 328/63 |
| 4,147,022 | 4/1979 | Ichikawa | 368/34 |
| 4,763,319 | 8/1988 | Descombs | 368/201 |

*Primary Examiner*—Bernard Roskoski

[57] ABSTRACT

An adjustable vibrations counter (20) and an elapsed time counter and switch (18) that select and adjust one second durations, the adjustment depending on whether the timekeeping rate of a watch or clock is fast or slow. The adjustable vibrations counter provides for an increase or decrease in the number of crystal (12) vibrations that are counted during each adjusted one second duration. The elapsed time counter and switch provides for the number of seconds that are selected for adjustment during each hour or day.

A slide switch (22) or other means for changing the number of crystal vibrations that are counted during an adjusted one second duration, thus providing the timekeeping rate regulation. A display (28) of the amount of timekeeping rate adjustment that has been entered into a watch or clock.

1 Claim, 2 Drawing Sheets

TIMEKEEPING RATE REGULATOR FOR CRYSTAL CONTROLLED WATCHES AND CLOCKS

BACKGROUND OF THE INVENTION

1. Field of the Invention This invention makes modifications to the electronic circuitry of crystal controlled watches and clocks. The modifications permit regulation of the timekeeping rate crystal controlled watches and clocks.

2. Description of the Prior Art

In about 1960, crystal controlled watches and clocks introduced a major improvement in the timekeeping accuracy of wrist watches, desk clocks, floor clocks, clocks installed in process control devices, etc.

A crystal controlled watch or clock typically utilizes a quartz crystal that is intended to vibrate at a frequency of exactly 32,768 hertz (32,768 vibrations per second). The crystal vibrations are electrically driven, usually by battery power.

An electronic counter in the watch or clock counts each vibration of the crystal. When the counter totals 32,768 vibrations, the time display is advanced one second.

It is virtually impossible to manufacture a crystal so that the crystal will vibrate at exactly 32,768 hertz. If the crystal vibrates at 32,768.2 hertz (instead of the desired 32,768 hertz) the watch or clock will gain time at a rate of 16 seconds per month. (0.2 vibrations per second $\times$3,600 seconds per hour $\times$732 hours per month (divided by) 32,768 vibrations per second=16 seconds per month.) A shock to the crystal, such as dropping a watch, may change the rate of vibration and thus the timekeeping accuracy. Aging of the crystal may also change the rate of vibration and timekeeping accuracy.

At present, crystal controlled watches and clocks do not include any provision for adjusting an incorrect rate of timekeeping. A quartz watch that gains 16 seconds per month will consistently add 16 seconds each month. After four months the watch will be a little more than one minute fast.

OBJECTS AND ADVANTAGES

Accordingly, several objects and advantages of my invention are:

(a) to provide devices which permit adjustment of the timekeeping rate of a crystal controlled watch or clock during the manufacturing process;

(b) to provide devices which permit adjustment of the timekeeping rate of a crystal controlled watch or clock, such adjustment being available to the owner of the watch or clock;

(c) to provide devices which permit compensation for a change in the rate of vibration of the crystal in a watch or clock, such change as may be caused by aging of the crystal, mechanical shock, etc.;

(d) to provide devices which permit adjustment of the time display of a watch or clock, so that the time display does not have to be manually adjusted to be in agreement with a reference time signal;

(e) to provide devices which permit making a very fine adjustment to the timekeeping rate of a crystal controlled watch or clock;

(f) the features added by this invention utilize devices, methods, and techniques that are currently readily available, and that can be added during the manufacture of crystal controlled watches and clocks.

SUMMARY

This invention adds devices to the electronic circuitry of crystal controlled watches and clocks. The added devices permit regulation of the rate at which crystal controlled watches and clocks keep time.

A crystal controlled watch or clock keeps time by counting vibrations of a crystal. Each one-second duration is measured by counting a fixed number (usually 32,768) of vibrations of the crystal. If the crystal vibrates faster (or slower) than the desired exact frequency, the timekeeping rate of the watch or clock will be fast (or slow). At present, no provisions are available for regulating the timekeeping rate of crystal controlled watches and clocks.

This invention adds devices that select one-second durations at periodic intervals. The selected seconds are adjusted by counting an adjusted number of crystal vibrations during each selected second. If the adjusted number of vibrations during a selected second is greater than (or less than) the 32,768 vibrations during the remaining seconds in each periodic interval, the effect is to slow (or increase) the overall average timekeeping rate of the watch or clock.

This invention permits the owner to adjust the number of vibrations that are counted during the selected one-second durations. This adjusted number provides the desired timekeeping rate regulation of the watch or clock.

This invention permits the owner to deliberately adjust the timekeeping rate to be faster or slower than exact timekeeping. Such adjustment would be temporary, for the purpose of bringing the time display into agreement with a reference time signal. This feature eliminates the need for manual adjustment of the time display.

This invention uses devices, methods, and techniques that are currently readily available, and that can be added during the manufacture of crystal controlled watches and clocks.

DRAWING FIGURES

DESCRIPTION —FIGS. 1 to 5

Figure 1:
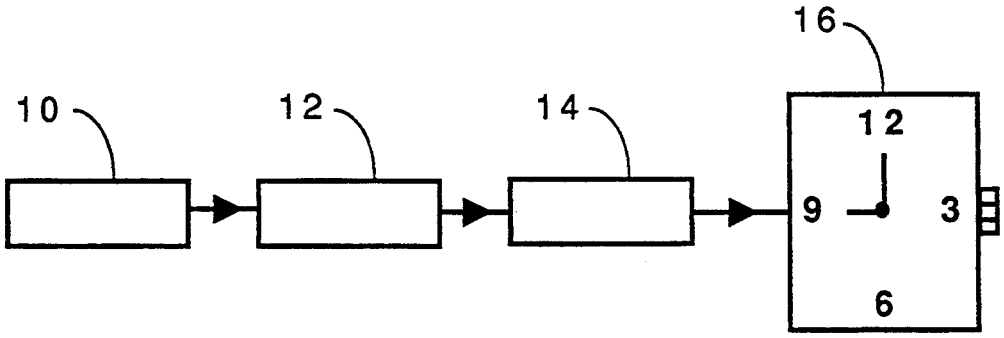
FIG. 1 shows a block diagram of electronic circuitry that is presently included in crystal controlled watches and clocks.

FIG. 1 shows a block diagram of electronic circuitry that is presently provided in crystal controlled watches and clocks. A battery 10 causes a crystal 12 to vibrate. The crystal vibrations send an alternating electrical signal to a vibrations counter 14. Vibrations counter 14 detects each vibration and counts the number of vibrations. When the count in vibrations counter 14 reaches 32,768 vibrations, counter 14 sends a signal to a time display 16 to advance the time display one second.

Counter 14 then starts again to count 32,768 vibrations, to again send a signal to advance time display 16 by one second. This process continues indefinitely. The circuitry shown in FIG. 1 is contained within the case of the watch or clock, except that in some clocks the battery may be outside the case for easy access to tile battery.

Figure 2:
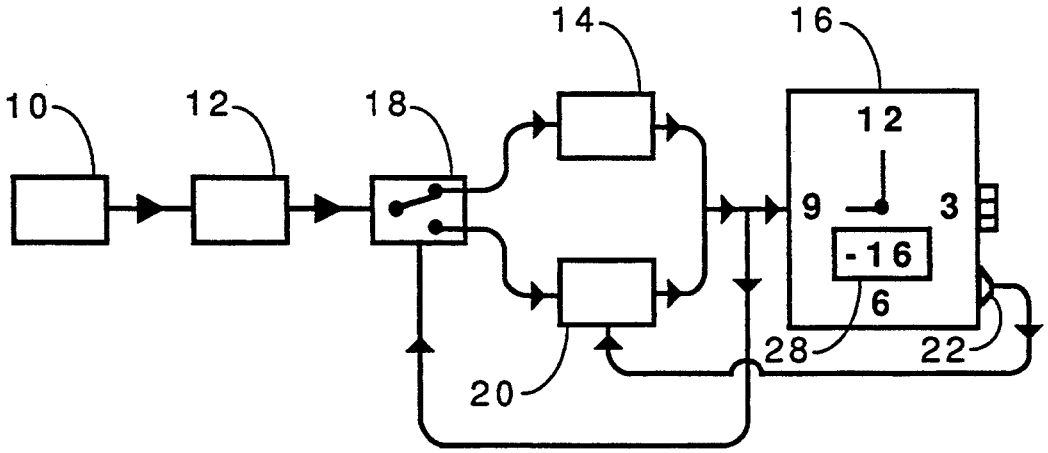
FIG. 2 shows a block diagram of electronic circuitry that embodies the devices that are added by this invention and that provide the timekeeping rate adjustment features of this invention.

FIG. 2 shows a block diagram of electronic circuitry that embodies the devices added by my invention. Alternating signals generated by the vibrations of crystal 12 pass through an elapsed time counter and switch 18 to vibrations counter 14. When the count in counter 14 reaches 32,768 vibrations, counter 14 sends a signal to time display 16 to advance the time display one second.

Each one-second signal sent by vibrations counter 14 to time display 16 is also sent to elapsed time counter and switch 18. Elapsed time counter and switch 18 counts each one-second signal. When the count of seconds in counter and switch 18 reaches a selected, pre-set number of seconds (for example, 3,600 seconds, equal to one hour), counter and switch 18 switches crystal 12 vibrations from vibrations counter 14 to an owner-adjustable vibrations counter 20. Now crystal 12 vibrations are counted by adjustable vibrations counter 20, and not by fixed vibrations counter 14.

After one adjusted second, as measured by adjustable vibrations counter 20, counter 20 sends a signal to time display 16 to advance the time display one second. This signal is also sent to elapsed time counter and switch 18, which immediately switches the count of crystal 12 vibrations back to vibrations counter 14. In the above example, with counter and switch 18 pre-set at 3,600 seconds, only one second in each 3,600 seconds is measured (adjusted) by adjustable vibrations counter 20. The remaining 3,599 seconds in each hour are measured by counting 32,768 vibrations as required by counter 14. This process continues indefinitely.

The number of crystal vibrations in each adjusted second will depend on the number that is entered into owner-adjustable vibrations counter 20. This number (typically less than or greater than 32,768) provides the desired adjustment to the overall average timekeeping rate of the watch or clock.

The circuitry shown in FIG. 2 is contained within the case of the watch or clock, except that in some clocks the battery may be outside the case for easy access to the battery.

Figure 3:
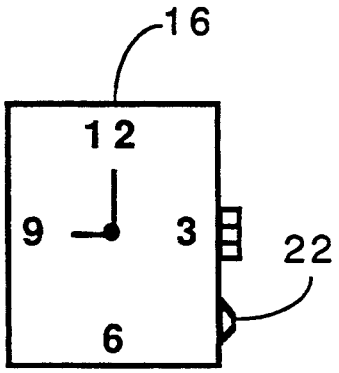
FIG. 3 shows a device that will permit a watch owner to adjust the rate of timekeeping.

FIG. 3 shows a device that will permit an owner to adjust the timekeeping rate of a watch or clock. Moving a timekeeping rate adjustment slide switch 22 to the "slower" or "faster" position will respectively increase or decrease the count number in owner-adjustable vibrations counter 20.

The "faster" and "slower" provisions of timekeeping rate adjustment slide switch 22 can be designed so that the owner would actuate slide switch 22 for the number of seconds corresponding to the desired adjustment to the timekeeping rate of the watch or clock. For example, if the owner wanted to slow a watch or clock 16 seconds per month, the owner would hold slide switch 22 in the "slower" position for 16 seconds. This action would make the necessary adjustment to the number in adjustable vibrations counter 20.

The owner would not need to know the actual number that is in adjustable vibrations counter 20. The owner would not need to do any calculations concerning the desired adjustment to the timekeeping rate of the watch or clock.

Figure 4:
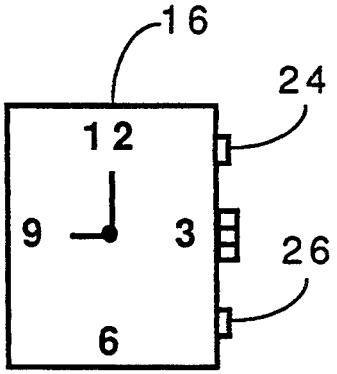
FIG. 4 shows an alternative device that will permit a watch owner to adjust the rate of timekeeping.

FIG. 4 shows an alternate device that will permit an owner to adjust the timekeeping rate of a watch or clock. Separate timekeeping rate adjustment push buttons 24 (faster) and 26 (slower) would function the same as slide switch 22 in FIG. 3 above.

Figure 5:
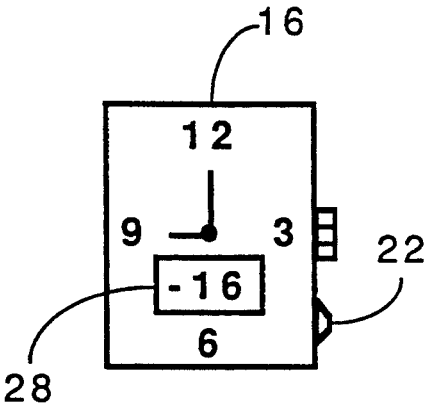
FIG. 5 shows a display of the amount of timekeeping rate adjustment that has been made to the basic timekeeping rate of a watch.

FIG. 5 shows a display 28 of the amount of timekeeping rate adjustment that has been made to the watch or clock. Display 28, an optional feature, would be a digital display and can correspond to the total timekeeping rate adjustment made to the watch or clock. For example, if the display showed 00 and the owner reduced the timekeeping rate 16 seconds per month, display 28 would show −16.

Operation—FIGS. 3 to 5

Suppose that a watch owner notes that his crystal controlled watch is gaining time at a rate of 16 seconds each month.

Suppose also that the pre-set number in elapsed time counter and switch 18 is 3,600. This means that only one one-second interval in each hour will be selected and measured by counting the number of crystal 12 vibrations corresponding to the owner-adjustable number that is in counter 20. Each of the remaining 3,599 seconds in each hour will be measured by counting 32,768 vibrations of crystal 12, in accordance with the fixed number (32,768) that is in counter 14.

In order to slow the timekeeping rate of the watch by 16 seconds per month, the total number of crystal vibrations that are counted in each hour must be increased 716 vibrations. (Sixteen seconds per month ×32,768 vibrations per second (divided by) 732 hours per month =716 vibrations per hour.)

Accordingly, the watch owner needs to add 716 to the number that is in adjustable vibrations counter 20. The owner may add 716 to counter 20 by holding slide switch 22 (or push button 26) in the "slower" position for 16 seconds. Consequently, once each hour one one-second interval will be increased 0.022 second. (716 vibrations (divided by) 32,768 vibrations per second=0.022 second.)

The effect would be to slow the overall average timekeeping rate of the watch 16 seconds per month. (0.022 second per hour ×732 hours per month=16 seconds per month).

FIGS. 3 and 4 show possible embodiments for changing the number in counter 20. The "slower" and "faster" provisions of slide switch 22 (FIG. 3) or push buttons 24 and 26 (FIG. 4) could be designed so that the duration of actuation would correspond to the desired timekeeping rate adjustment. For example, in order to slow the watch sixteen seconds per month, the owner would actuate the "slower" provision of slide switch 22 or push button 26 for 16 seconds. This action would add 716 to the count number in counter 20, thus slowing the timekeeping rate of the watch 16 seconds per month.

It is noted that elapsed time counter and switch 18 could be pre-set to a number other than 3,600 seconds. For example, if counter and switch 18 were pre-set to 1,800 seconds (30 minutes), the number in vibrations counter 20 would need to be increased only 358 in order to slow the timekeeping rate 16 seconds per month. (Sixteen seconds per month ×32,768 vibrations per second (divided by) 732 hours per month (divided by) 2 half-hours per hour=358 vibrations per half-hour.) With this arrangement, once each 30 minutes one one-second interval would be increased 0.011 second. (358 vibrations (divided by) 32,768 vibrations per second =0.011 second.)

If elapsed time counter and switch 18 were pre-set to 43,200 seconds (12 hours), only two one-second intervals per day would be measured (adjusted) by adjustable vibrations counter 20. This would mean that an increase of 716 in the number that is in counter 20 would slow the timekeeping rate of the watch 16 seconds per year, instead of 16 seconds per month. (716 vibrations per 12 hours×24 hours per day ×365.2 days per year (divided by) 32,768 vibrations per second =16 seconds per year.)

FIG. 5 shows an optional display of the amount of timekeeping rate adjustment that has been made to the watch. Display 28 would correspond to the timekeeping rate adjustment. For example, a display of −16 would mean that the timekeeping rate of the watch has been slowed 16 seconds per month. Display 28 could be made to correspond with a timekeeping rate adjustment of seconds per year, rather than seconds per month.

The watch owner can use the embodiments of this invention to make adjustments to the time display, with no need to make manual adjustments to the time display. For example, suppose the timekeeping rate was correct but the watch displayed a time that was ten seconds behind the correct time. By holding slide switch 22 (or push button 24) in the "faster" position for 30 seconds, the owner would (for example) make a 30 seconds per month (one second per day) increase in the timekeeping rate. In ten days, the time display would agree with correct time and the owner would then return the watch to the correct timekeeping rate by holding slide switch 22 (or push button 26) in the "slower" position for 30 seconds.

It is noted that a watch manufacturer may elect not to provide the owner-adjustable features of this invention. A manufacturer may elect to add only elapsed time counter and switch 18 and adjustable vibrations counter 20. Such limited embodiment of this invention would permit a manufacturer to make an adjustment to the initial timekeeping rate of a watch or clock. The watch or clock would leave the factory with a timekeeping rate selected by the manufacturer. In such limited embodiment of this invention the owner would not have access to adjustable vibrations counter 20, and would not be able to make timekeeping rate adjustments.

Conclusion, Ramifications, and Scope

The reader will see that the embodiments of this invention will provide the manufacturer and owner of a crystal controlled watch or clock with an easy-to-use regulation of timekeeping accuracy.

Timekeeping rate adjustments, measured in seconds per year, are readily attainable. Any changes to timekeeping accuracy that may result from aging of the crystal, or dropping the watch or clock, etc., are easily corrected by the embodiments of this invention.

Crystal controlled watches and clocks introduced a major improvement in the timekeeping accuracy of wrist watches, desk clocks, floor clocks, clocks installed in process control devices, etc. This invention adds a major improvement to the timekeeping accuracy of crystal controlled watches and clocks.

Many variations are possible concerning the embodiments discussed above. Although the Description, and Operation, contain many specifics, these should not be construed as limiting the scope of the invention. The specifics provide illustrations of some of the presently preferred embodiments of this invention.

Thus the scope of this invention should be determined by the appended claims and their legal equivalents, rather than by the examples given.

I claim:

1. A watch comprising:

a time display means;

vibrating means for supplying signals to a counter switch means;

said switch means supplying said signals in a first instance to a counter means, said counter means providing an output to said time display means and;

in a second instance to an adjustable counter; said adjustable counter providing output to said display means;

external switch means for supplying a correction signal to said variable counter means to increase or decrease the count in said variable counter means; and means for displaying the increase or the decrease in the count;

whereby an error in the time rate is corrected by said external switch means with the increase in the count or the decrease in the count being displayed on the time display means.

* * * * *